US005921032A

United States Patent [19]

Labinski

[11] Patent Number: 5,921,032

[45] Date of Patent: Jul. 13, 1999

[54] CONVERTIBLE SPORTS AND EXHIBITION FACILITY AND CONVERSION METHOD

[75] Inventor: Ronald J. Labinski, Fairway, Kans.

[73] Assignee: Hellmuth Obata & Kassabaum, Inc., Kansas City, Mo.

[21] Appl. No.: 09/001,312

[22] Filed: Dec. 31, 1997

[51] Int. Cl.[6] ..... E04H 3/12

[52] U.S. Cl. ..... 52/9; 52/8; 52/10; 52/66

[58] Field of Search ..... 52/8, 9, 66, 10; 472/92

[56] References Cited

U.S. PATENT DOCUMENTS

| | | | |
|---|---|---|---|
| 1,433,547 | 10/1922 | Hadden | 52/9 |
| 3,002,234 | 10/1961 | Waterbury | 52/9 |
| 3,241,270 | 3/1966 | Newman | 52/9 |
| 3,525,184 | 8/1970 | Harbers et al. . | |
| 3,975,869 | 8/1976 | Bouton | 52/9 |
| 4,162,594 | 7/1979 | Mackintosh . | |
| 4,688,357 | 8/1987 | Deaton | 52/9 |
| 5,103,600 | 4/1992 | Geiger et al. . | |
| 5,794,383 | 8/1998 | Labinski | 52/9 |

FOREIGN PATENT DOCUMENTS 406200644 7/1994 Japan .

OTHER PUBLICATIONS

The Sunday Times, Apr. 23, 1989, "Time to Mourn—Time to Build".

Turfdome Soccer Stadium Prototype Design; Hellmuth, Obata & Kassabaum, Inc. Sports Facilities Group Architecture, Interiors, Planning, Graphics, Engineering.

*Primary Examiner*—Christopher Kent

*Attorney, Agent, or Firm*—Mark E. Brown; Litman, Kraai & Brown LLC

[57] ABSTRACT

A convertible sports and exhibition facility includes stadium and arena configurations. Playing fields or surfaces are provided for both the stadium and arena configurations, with at least a portion of the stadium playing field being removable to provide a lower playing surface in the arena configuration. A seating system includes opposite pairs of end and side seating sections. The stadium configuration end seating sections become the arena configuration side seating sections and portions of the stadium side seating sections become the arena end seating sections when the facility is converted from a stadium configuration to an arena configuration. The facility includes a roof with an adjustable-height ceiling portion with a raised stadium position and a lowered arena position. The facility also includes circulation, structure and support systems.

16 Claims, 12 Drawing Sheets

CONVERTIBLE SPORTS AND EXHIBITION FACILITY AND CONVERSION METHOD

BACKGROUND OF THE INVENTION

1. Field of the Invention

The present invention relates generally to sports and exhibition facilities, and in particular to a facility which can be converted between stadium and arena configurations for accommodating different sports and other activities.

2. Description of the Related Art

Spectator sports comprise a major form of entertainment worldwide. Although live broadcast media coverage is available for many events, spectator attendance continues to be a major revenue source for team franchises. Professional sporting event venues range in size from arenas which are typically used for sports such as basketball, hockey and soccer to stadiums which can accommodate professional football.

Municipalities and geographic regions are under considerable pressure to provide appropriate state-of-the-art facilities for staging sporting and other events, such as concerts, exhibitions, conventions, trade shows and the like. Movement of sports franchises among different markets is commonplace. Sports franchise owners often take advantage of the marketability and portability of their respective teams to solicit proposals from competing venues. Thus, sports and exhibition facilities are continuously being upgraded and replaced in order to remain competitive with other available venues.

State-of-the-art sports and exhibition facilities typically represent major capital expenditures. Hence, there is a significant advantage to providing a multi-purpose facility which can be utilized in several sports seasons and which can also accommodate conventions, exhibitions and the like.

Multi-purpose sports and exhibition facilities have been proposed before. The Labinski U.S. Pat. No. 5,794,383 for Reconfigurable Seating System for Multi-Purpose Stadium is incorporated herein by reference and discloses a stadium which is convertible between baseball and football configurations. The Miyagawa Japanese Patent No. 406200644 discloses a seating area layout variable system of multi-purpose arena, with the ability to convert between baseball and soccer configurations.

Facilities have previously been designed with moveable seating sections and vertically adjustable playing fields and roofs. For example, a soccer facility has been proposed with a playing surface adapted for being raised hydraulically to a roof level. The facility also includes a longitudinally moveable seating stand for altering the playing area size. The Geiger et al. U.S. Pat. No. 5,103,600 also discloses a multi-purpose stadium with a roof structure which can be raised and lowered and with seating which can be reconfigured.

Generally speaking, spectator sports are best enjoyed in facilities which are specially configured for a particular sport or sports. Factors such as total capacity, sight lines, private suite/open seating mix ratios and proximity to the game play can either enhance or detract from the spectator experience. For example, sports such as football are generally played in large stadiums with optimal seating capacities in the range of about 65,000 to 70,000. Sports such as basketball and hockey, on the other hand, are generally played in smaller venues with the spectators seated closer to the court or rink. Thus, a convertible facility would preferably provide the experience associated with single-purpose stadiums and arenas with optimal seating capacities, sight lines and spectator proximity. Still further, a convertible facility would preferably include a ceiling which can be raised or lowered to accommodate the size and scale of the seating bowl with which it was associated.

Heretofore there has not been available a convertible sports and exhibition facility with the advantages and features of the present invention.

SUMMARY OF THE INVENTION

In the practice of the present invention, a sports and exhibition facility is provided which is convertible between stadium and arena configurations. The facility includes an activity area with stadium and arena playing fields or surfaces. The facility also includes a seating system with opposite end seating sections and opposite side seating sections collectively forming a seating bowl generally surrounding a respective activity area. The seating system includes a movable component of an end seating section adapted for sliding longitudinally with respect to the stadium playing field for movement between stadium and arena positions. The seating system also includes a retractable seating band, which can be retracted out of the way to provide clearance for the movable component of the end seating section to traverse the stadium playing field longitudinally. Temporary seating bands are installed around the inside of the arena seating bowl. The stadium playing field surface can be at least partly removed to provide a lower arena playing surface.

A circulation system includes concourses which are located at different levels generally behind and beneath the seating bowl. A ceiling system includes a roof supporting a ceiling with an adjustable-height portion. A facility structure provides structural support for the seating, circulation, ceiling and other systems of the facility. A support system of the facility accommodates a variety of support functions, such as service, locker rooms, mechanical facilities, concessions, toilets, etc.

OBJECTS AND ADVANTAGES OF THE INVENTION

The principle objects and advantages of the present invention include providing a convertible sports and exhibition facility and a conversion method therefor, providing such a facility which is adapted to accommodate various sports and other activities; providing such a facility which provides a spectator experience which is comparable to the spectator experience in a single-purpose facility, providing such a facility which accommodates spectator audiences of different sizes; providing such a facility which optimizes sight lines and viewing for different sports and other activities; provided such a facility which can be efficiently reconfigured; providing such a facility which includes a playing field which is at least partly removable; providing such a facility which includes a roof having a ceiling with an adjustable-height portion; and providing such a facility which is economical to produce, efficient in operation and particularly well designed for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
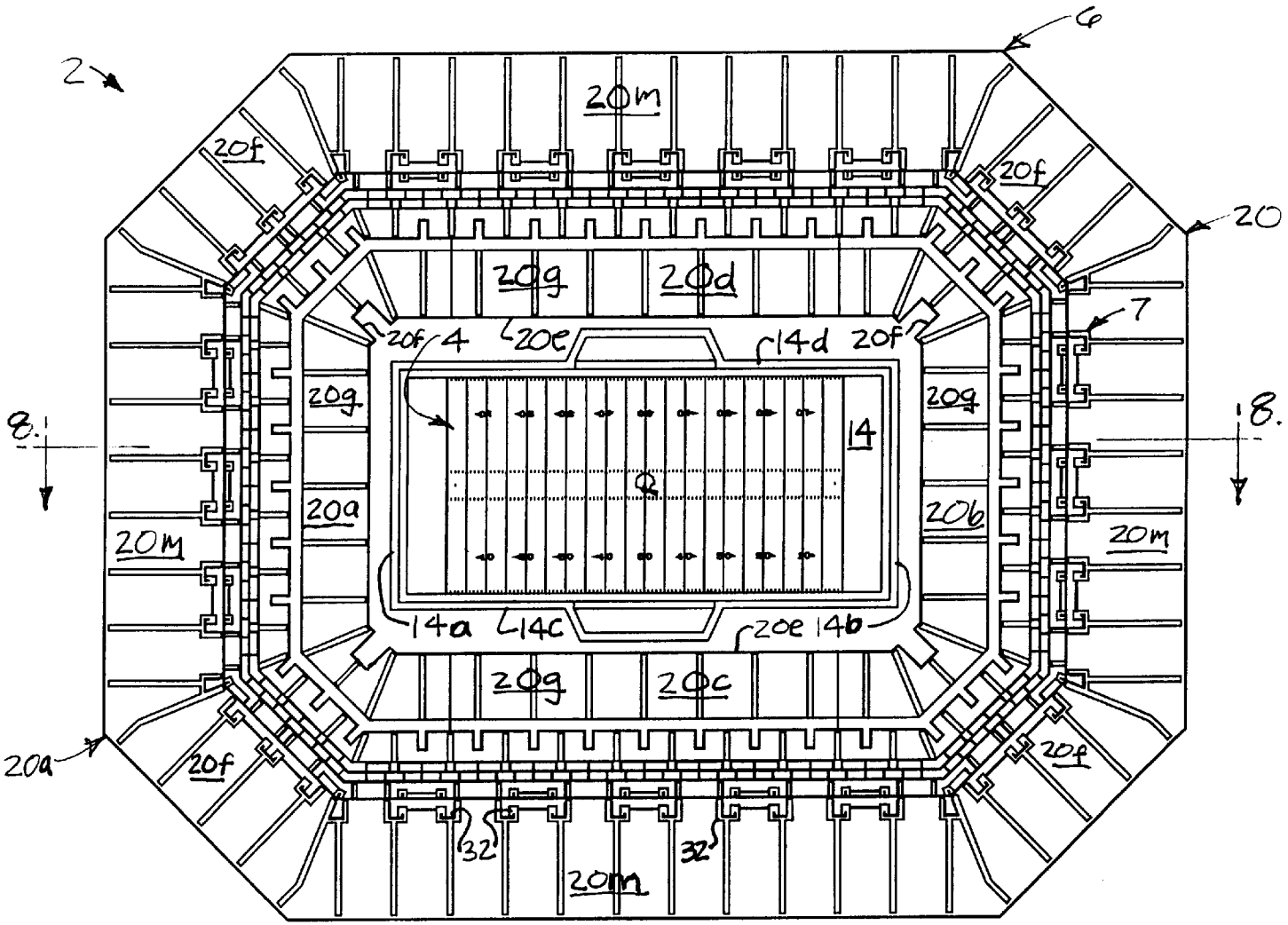
FIG. 1 is a top plan view of a convertible sports and exhibition facility embodying the present invention, shown in a football stadium configuration.
Figure 2:
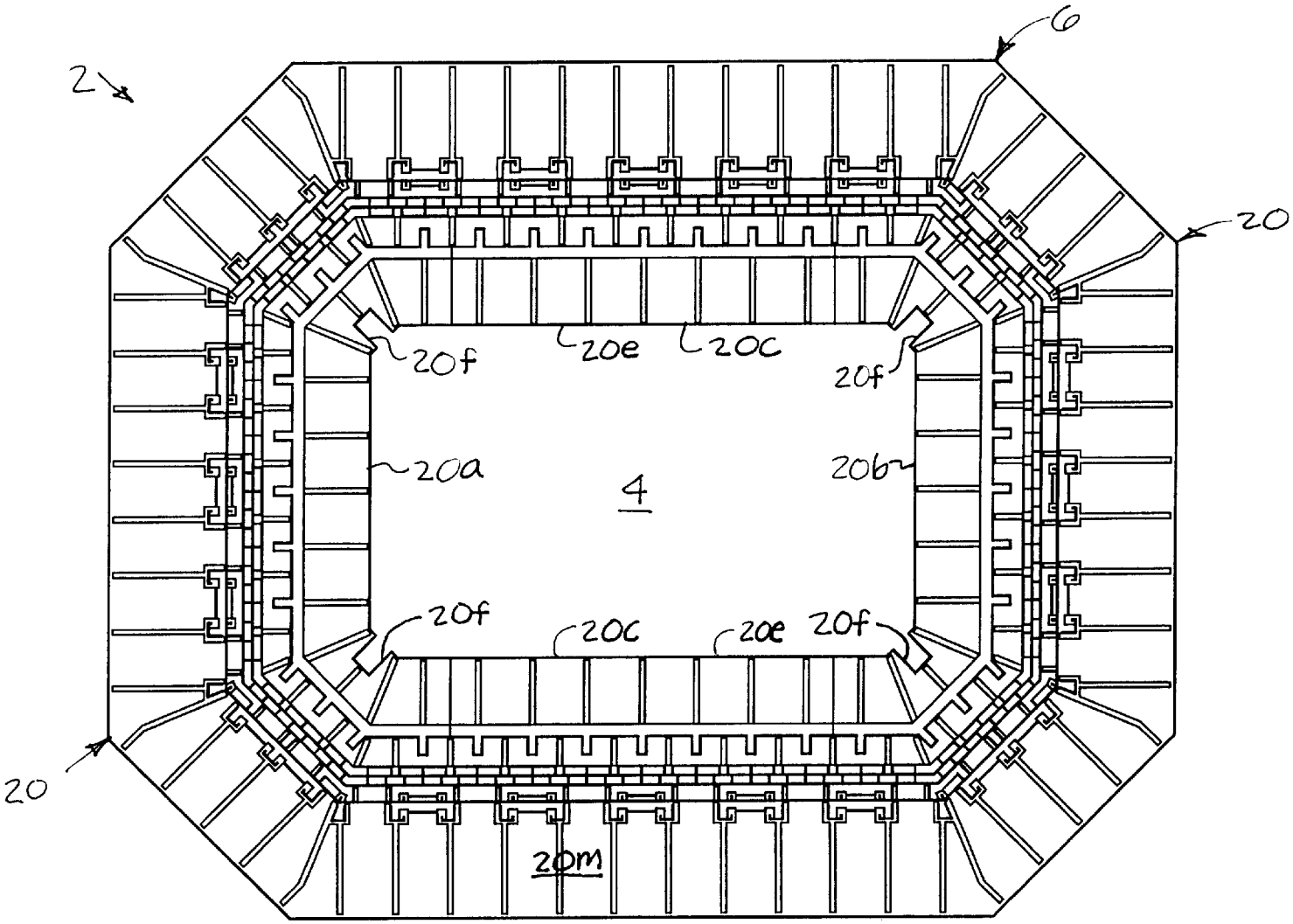
FIG. 2 is a top plan view of the facility, shown with the football playing field markings removed.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 7A:
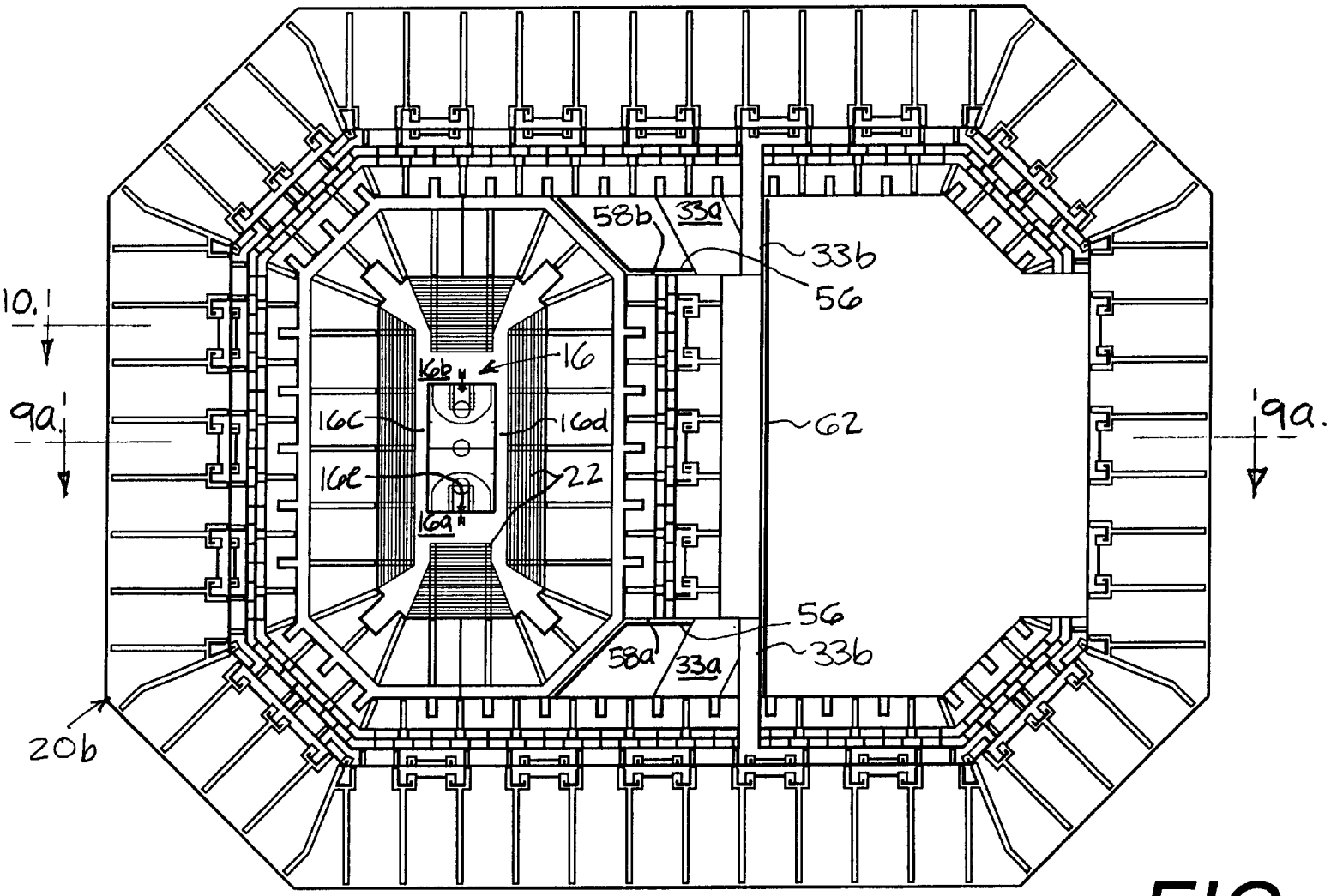
FIG. 7*a* is a top plan view of the facility, showing the arena configuration thereof with a basketball court.
Figure 7B:
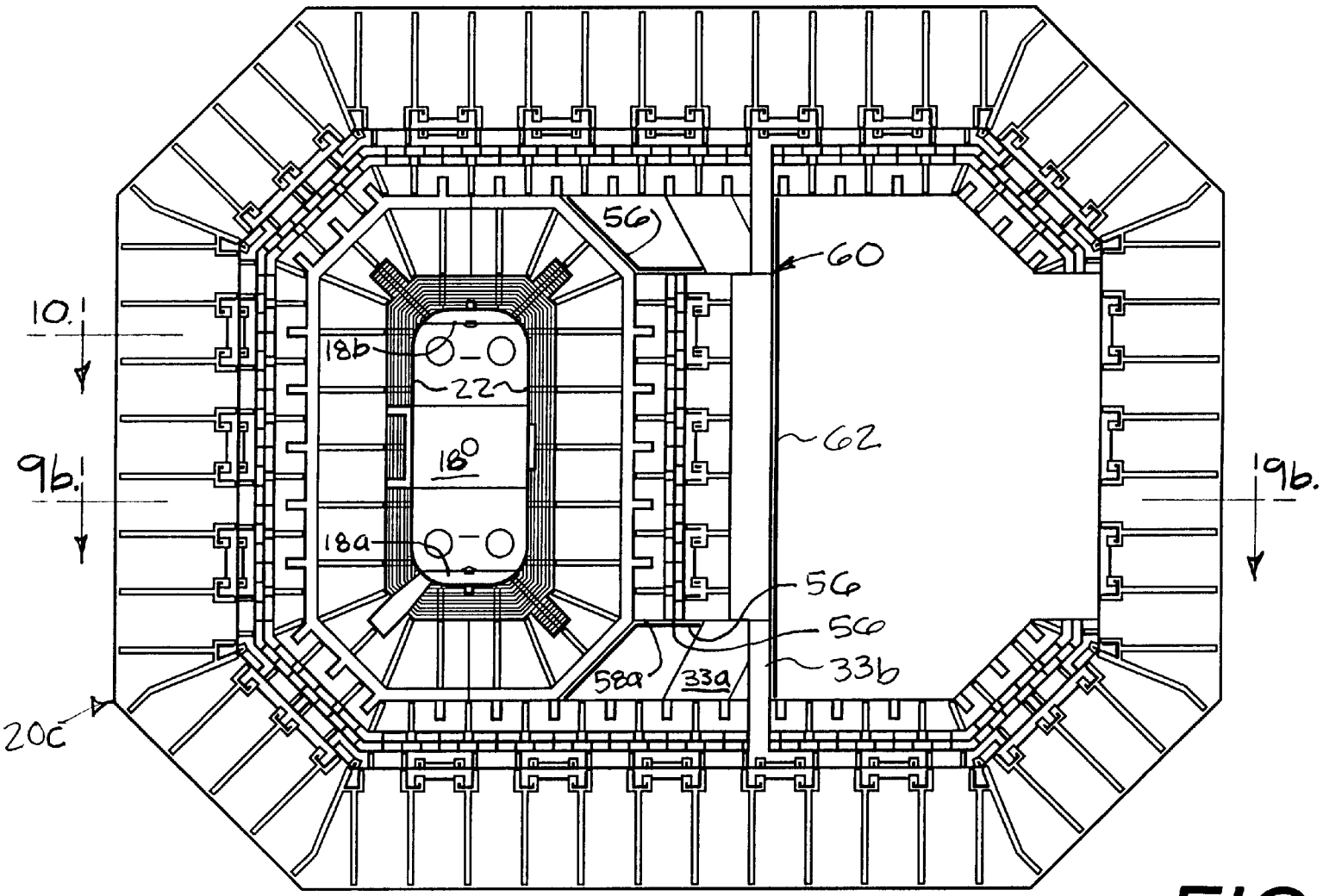
FIG. 7*b* is a top plan view of the facility, showing the arena configuration thereof with a hockey rink.

Referring to the drawings in more detail, the reference numeral 2 generally designates a convertible sports and exhibition facility embodying the present invention. The convertible facility 2 generally includes an activity area 4, a seating system 6, a circulation system 7, a ceiling system 8, a facility structure 10 and a support system 12. The facility 2 is generally convertible between a stadium configuration (FIG. 1), accommodating such sports as football, and an arena configuration (FIGS. 7*a* and 7*b*), accommodating such sports as basketball and hockey. However, the convertible facility 2 can accommodate a wide range of other activities, including other sporting events, entertainment, exhibitions, conventions, trade shows and meetings of various types.

II. Activity Area 4

The activity area 4 is adaptable for configuration as a football playing field 14 in a stadium configuration, or as either a basketball court 16 or a hockey rink 18 in an arena configuration.

Figure 10:
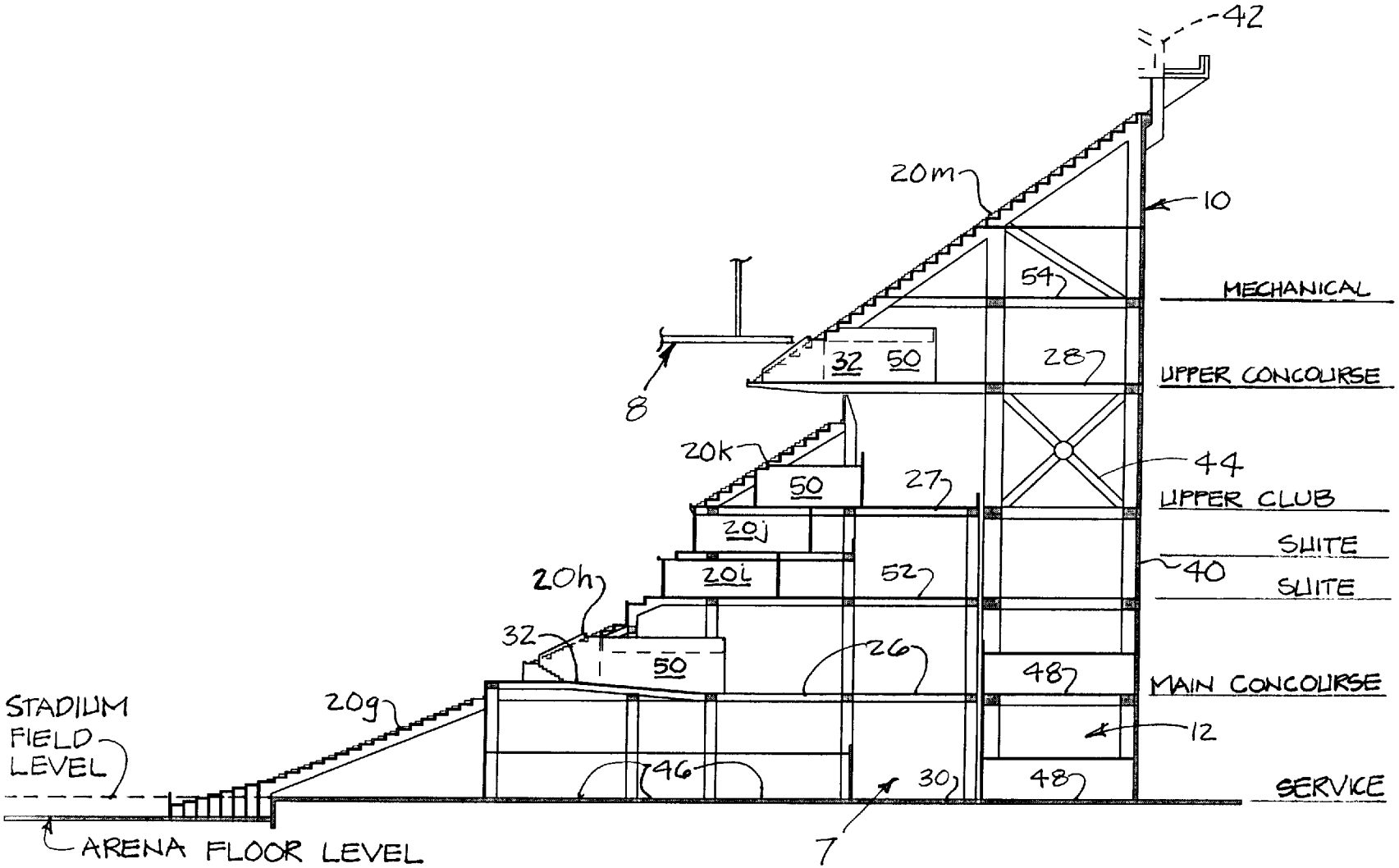
FIG. 10 is an enlarged, fragmentary, longitudinal, cross-sectional view of the facility, taken generally along line 10 in FIGS. 7*a* and 7*b*.

The football playing field 14 includes a pair of opposite ends 14*a,b* and a pair of opposite sides 14*c,d*. A pair of goal posts 14*e* are mounted in the playing field ends 14*a*. As shown in FIG. 10, the football playing field 14 is located at a raised level, which generally corresponds to a service level of the facility 2.

In an arena configuration, the basketball court 16 includes opposite ends 16*a,b;* opposite sides 16*c,d;* and a pair of goals 16*e* each located at a respective court end 16*a,b*. Also in an arena configuration, the hockey rink 18 includes opposite ends 18*a,b;* opposite sides 18*c,d;* and a pair of goals 18*e* each located at a respective hockey rink end 18*a,b*. The basketball court 16 and the hockey rink 18 are located at lower levels, generally identified as the arena floor level, positioned somewhat below the level of the football playing field 14, which includes a removable portion over the basketball court 16 or the hockey rink 18 (FIG. 10).

The choice of playing surfaces in the activity area 4 is virtually unlimited and can include natural and artificial turf, ice, hardwood flooring, carpet, etc. Various different types of commercial flooring systems are available to accommodate different sports in the facility 2.

III. Seating System 6

Figure 3:
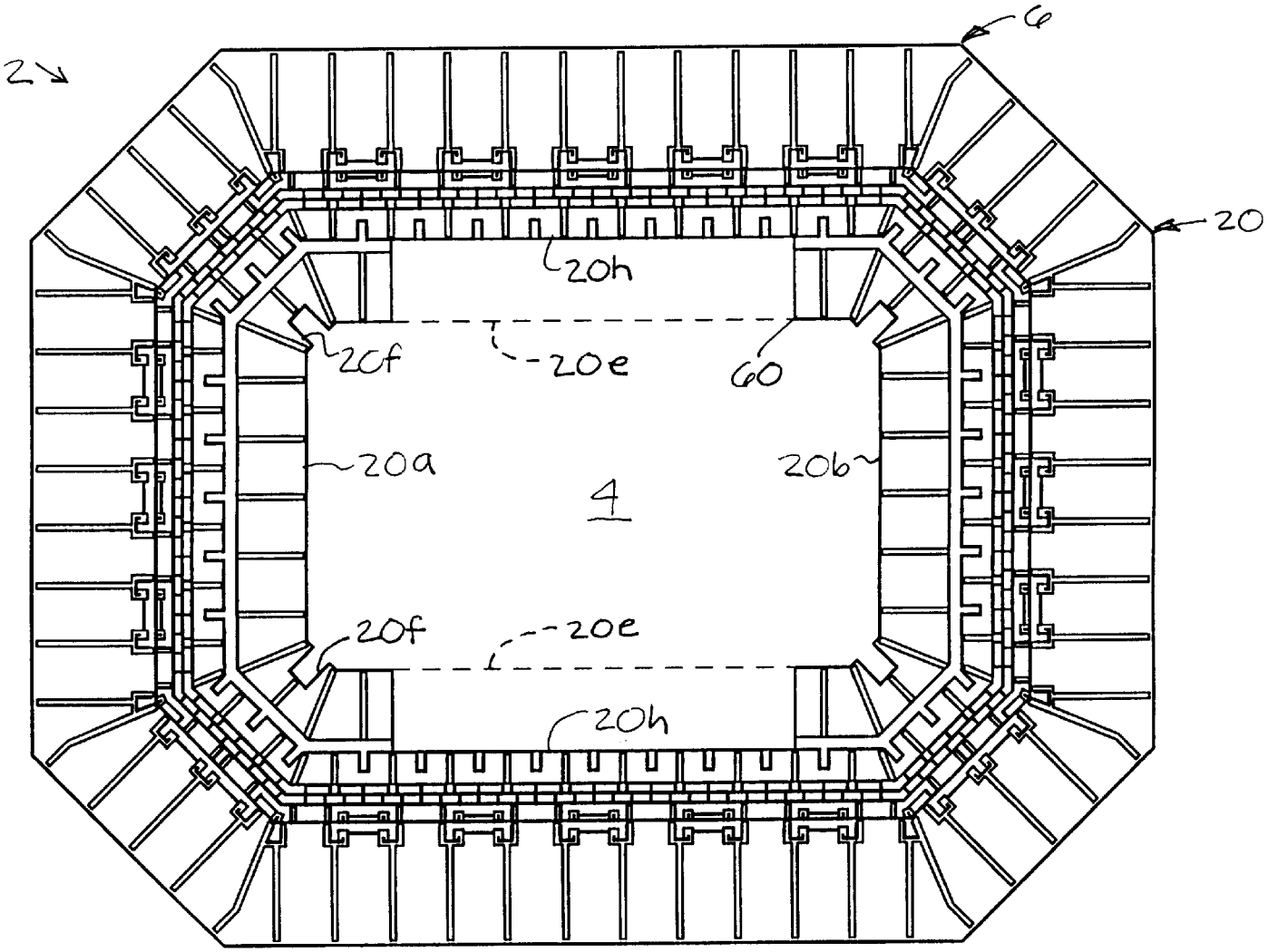
FIG. 3 is a top plan view of the facility, shown with a retractable seating band retracted into side sections of the seating system.
Figure 4:
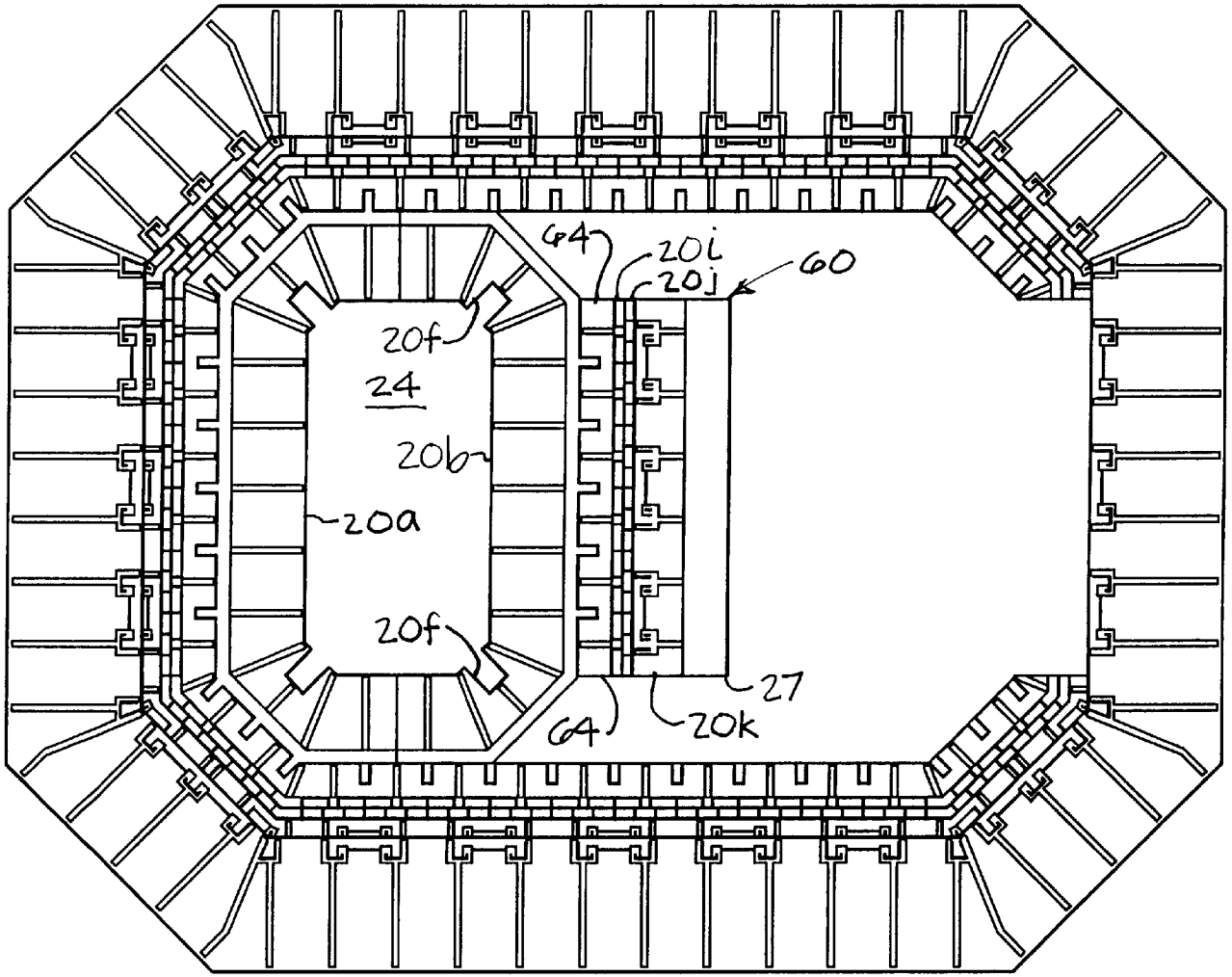
FIG. 4 is a top plan view of the facility, shown with a moveable component of a seating end section relocated from a stadium position to an arena position.

The seating system 6 includes a stadium seating bowl 20 in a stadium configuration with opposite end sections 20*a,b* and opposite side sections 20*c,d*. Each side section 20*c,d* includes a retractable seating band 20*e* adjacent to the playing field 14 and horizontally moveable outwardly therefrom for retraction to a stored position (FIG. 3). Seating sections 20*a,c* and *d* comprise fixed or stationery sections; end section 20*b* is partly movable. Corner seating sections 20*f* are located at each corner of the facility 2 and interconnect respective end and side seating sections 20*a,b* and 20*c,d* at suitable angles of, for example, about 45°.

In an arena configuration for basketball (FIG. 7*a*) or hockey (FIG. 7*b*), a respective arena seating bowl 21*a,b* includes removable or temporary seating bands 22, which are provided on the inside of the respective seating sections 20*a,b,c,d* adjacent to the basketball court 16 or the hockey rink 18.

FIG. 10 is an enlarged cross section of a movable component 60 of the end seating section 20*b,* showing the disconnection of the movable component 60 from the fixed or stationery components of the end section 20*b*. The removable or temporary seating bands 22, which are used in an arena configuration, are shown at the far left of the seating section 20*b* resting on an arena activity area or floor 24 (FIG. 10). Proceeding upwardly and outwardly, a lower deck 20*g* extends between a service level and a main concourse level. A club deck 20*h* extends between the main concourse level and a lower suite level. Lower and upper suites 20*i,j* are provided at lower and upper suite levels respectively. An upper club deck 20*k* extends between an upper club level and an upper concourse level. The seating described thus far is either removable or movable with the movable component 60 of the end section 20*b*. An upper deck 20*m* extends from the upper concourse level to the top of the seating bowl 20 and is fixed in position.

IV. Circulation System 7

As shown in FIG. 10, a circulation system 7 provides pedestrian and vehicle circulation in the facility 2 and includes a main or lower concourse 26 at a main concourse level, an intermediate or upper club level concourse 27 at the upper club level and an upper concourse 28 at an upper concourse level. A service drive 30 is provided at a service drive level. The circulation system 7 includes a plurality of vomitoria 32 for providing access from the concourses 26, 28 to respective seating decks.

Figure 5:
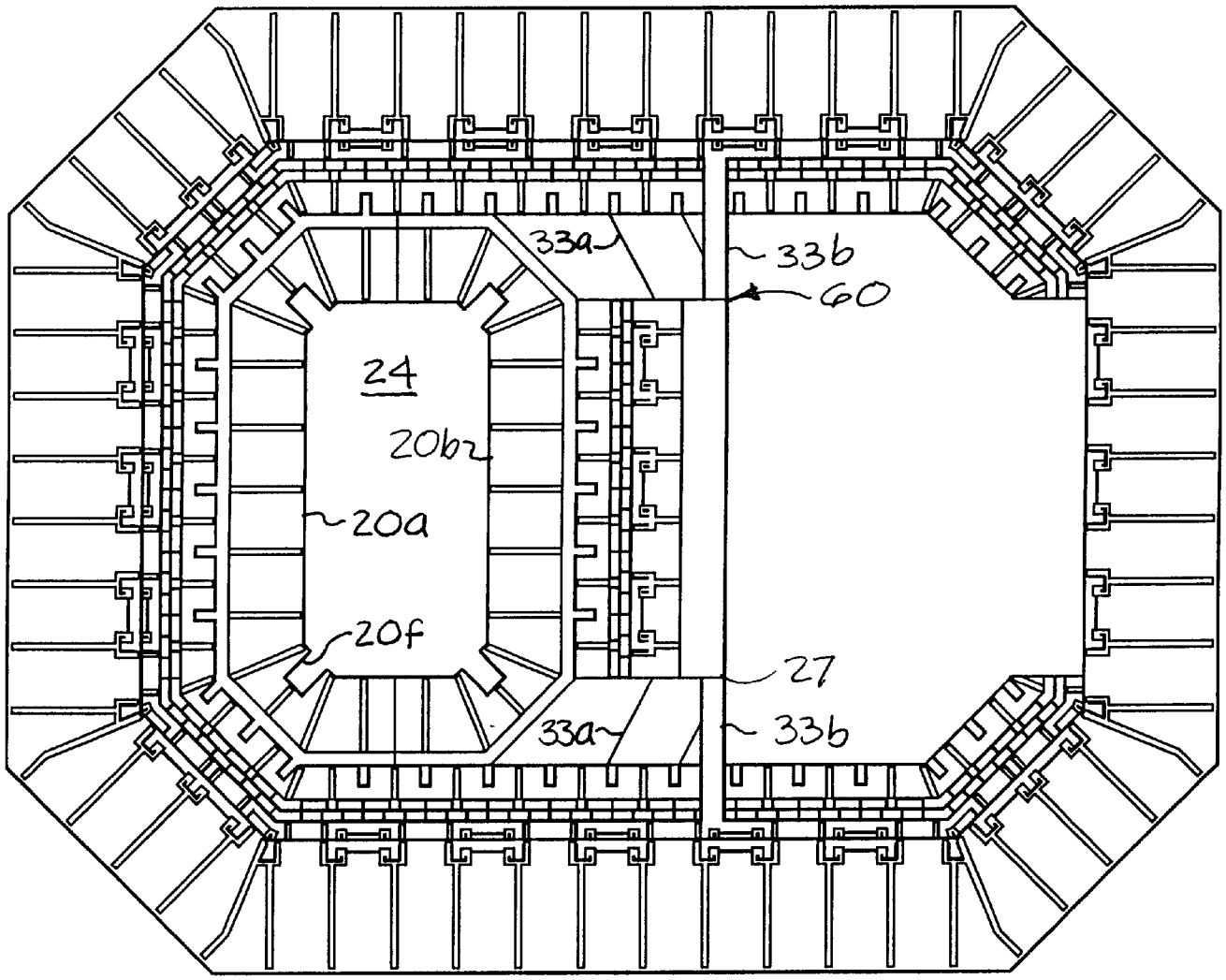
FIG. 5 is a top plan view of the facility, showing the installation of bridges in a circulation system.
Figure 6:
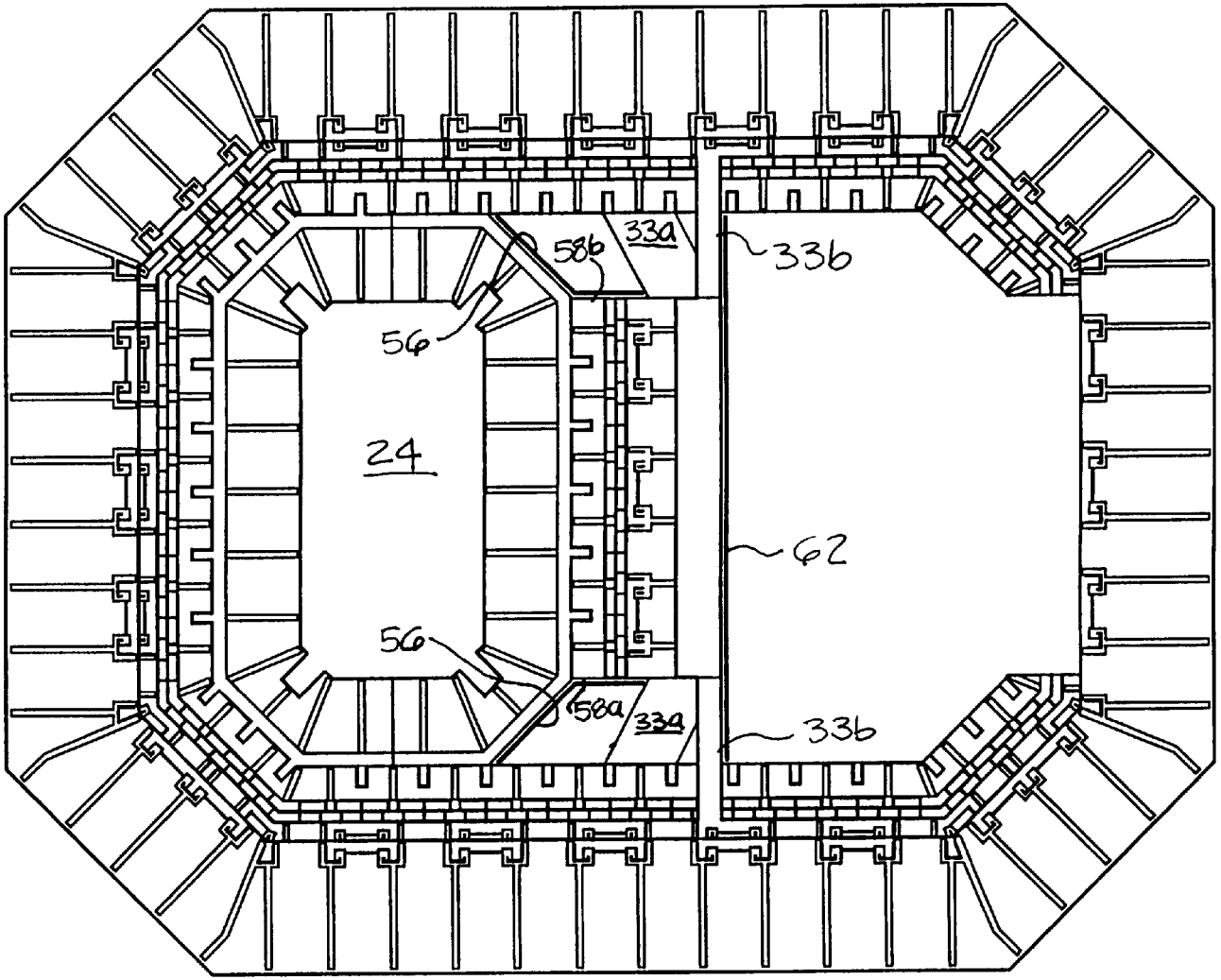
FIG. 6 is a top plan view of the facility, showing the installation of screening curtains for the facility in its arena configuration.

In a football stadium configuration (FIG. 1), the concourses 26, 28 form continuous loops around the stadium seating bowl 20. In an arena configuration (FIGS. 7*a* and 7*b*), bridges 33*a,b* are provided for spanning gaps formed in the seating bowls 21*a,b* as a result of displacing the movable component 60 of the end section 20*b*. Main concourse bridges 33*a* connect the portions of the main concourse 26 which extend through the movable component 60 of the end section 20*b* and the side sections 20*c,d* (FIG. 5). Upper club level or intermediate concourse bridges 33*b* connect the portions of the intermediate concourse 28 which extend through the movable component 60 of the end section 20*b* and the side sections 20*c,d* at the upper club level (FIG. 5).

V. Ceiling System 8

Figure 8:
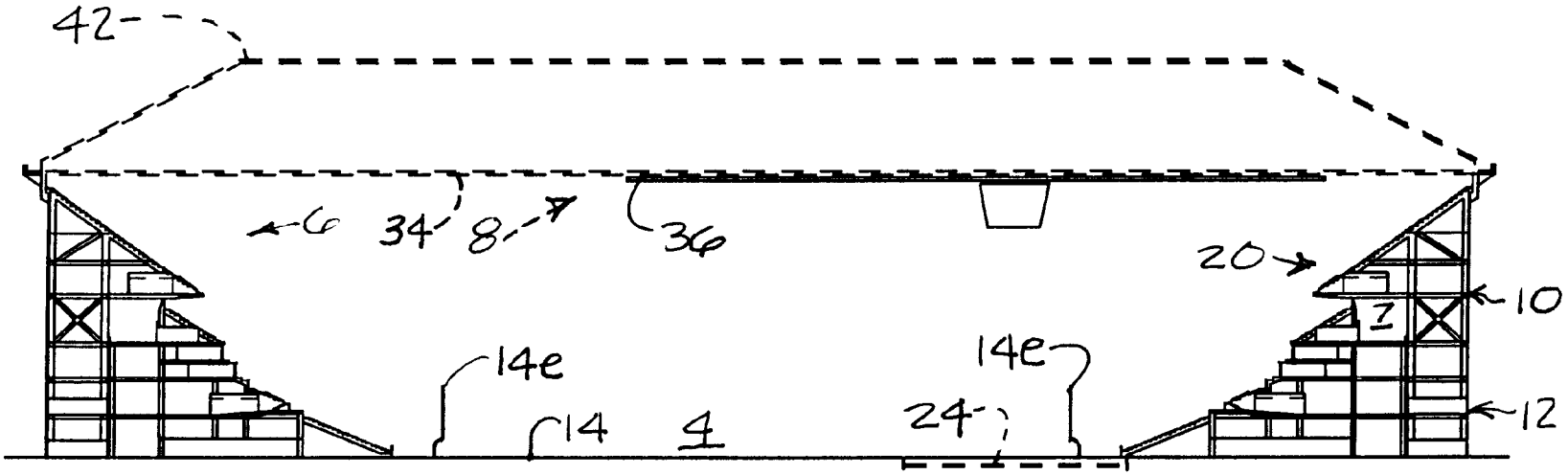
FIG. 8 is a longitudinal, cross-sectional view of the facility in the football stadium configuration thereof, taken generally along the line 8—8 in FIG. 1.
Figure 9A:
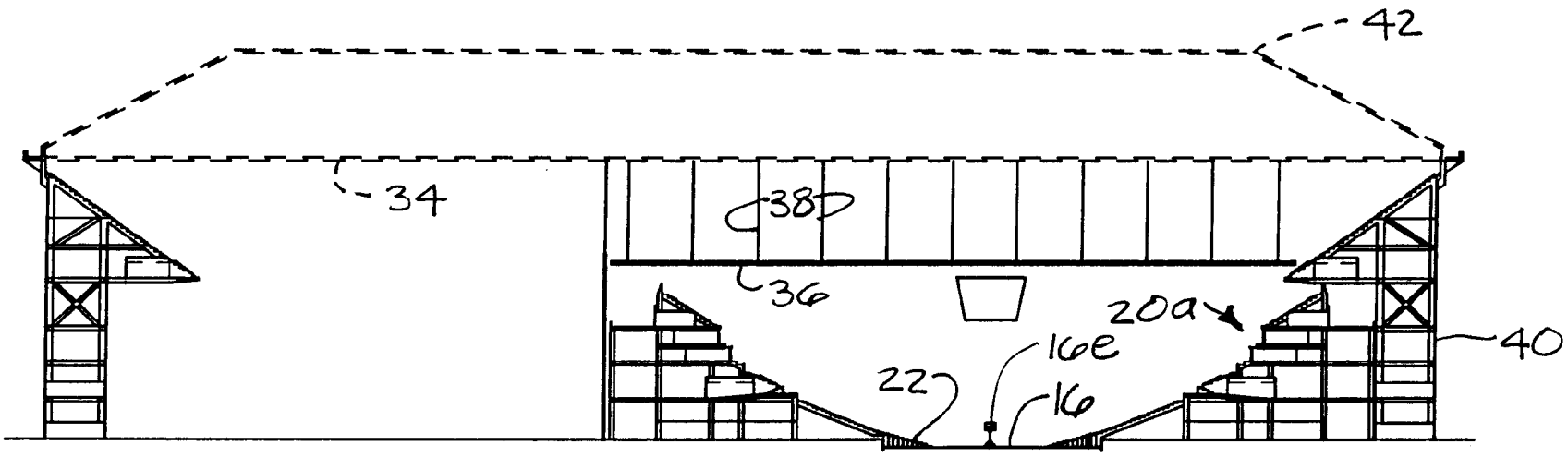
FIG. 9*a* is a longitudinal, cross-sectional view of the facility in the basketball court arena configuration thereof, taken generally along line 9*a*—9*a* in FIG. 7*a*.
Figure 9B:
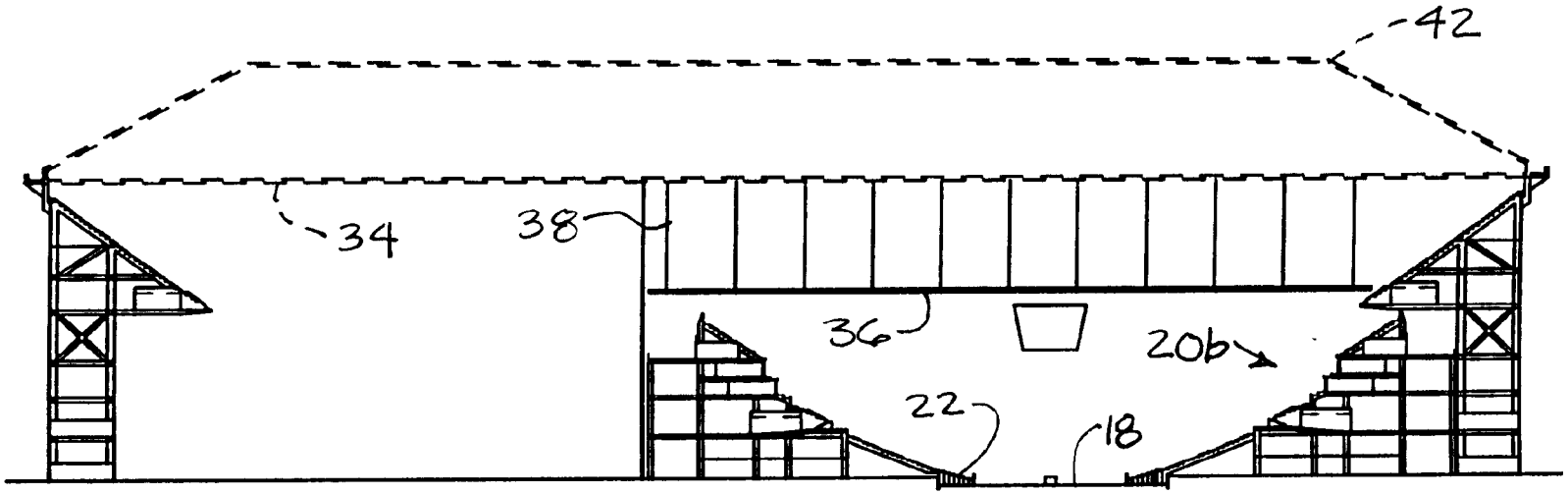
FIG. 9*b* is a longitudinal, cross-sectional view of the facility in the hockey rink arena configuration thereof, taken generally along line 9*b*—9*b* in FIG. 7*b*.

The ceiling system 8 includes a fixed-height portion 34 covering most of the facility 2 and an adjustable-height portion 36 generally covering the arena seating bowl 20*b,c* (FIGS. 8–10). The adjustable-height ceiling portion 36 is suspended by cables 38 and is adapted for raising and lowering between an upper position substantially flush with the fixed-height ceiling portion 34 and a lower position at approximately the upper concourse level.

VI. Facility Structure 10

The facility structure 10 can generally comprise a conventional stadium or arena structural system with appropriate modifications to accommodate the moveable components. Thus, the structure 10 includes an exterior wall 40 supporting a long-span roof 42, which could comprise a dome. A reinforced concrete and/or steel structural framework 44 provides the structural support for the seating system 6, the exterior wall 40, the circulation system 7 and the support system 12.

VII. Support System 12

The support system 12 generally supports the various functions associated with the operation and use of the facility 2, and includes service, locker and mechanical accommodations 46 located at the service level below the main concourse 26 and offices 48 at the service and main concourse levels. Concession and toilet accommodations 50 are provided at the main concourse level generally below and outside of the club deck 20*h* and at the upper concourse level. Club lounges 52 are located at the suite levels and support the lower and upper suites 20*i,j*. Additional mechanical accommodations 54 are located at the mechanical level above the upper concourse 28. Various other support components, equipment, accommodations, etc. can be located at suitable locations in the facility 2.

A pair of wing screening curtains 56 are located generally at respective exposed sides 58*a,b* of a moveable component 60 of the end section 20*b*. A transverse screening curtain 62 extends generally between the side seating sections 20*c,d* along an outer end 64 of the moveable component 60. The screening curtains 56, 62 function to enclose the arena seating bowls 20*b,c* and screen unused parts of the stadium seating bowl 20*a* with the facility 2 in an arena configuration. The screening curtains 56, 62, the lowered ceiling portion 36, the lower basketball court 16 or hockey rink 18 and the relocated moveable seating component 60 cooperate to provide the reduced scale of a considerably smaller facility in an arena configuration. The net effect is to provide a spectator experience normally associated with smaller, single-use sports arenas.

VIII. Operation

In operation, the facility 2 is convertible from a stadium configuration (FIG. 1) to arena configurations (FIGS. 7*a* and 7*b*) and vise versa. FIGS. 1–7*a,b* show the sequential steps for converting the facility 2. However, other conversion steps and different conversion step sequences could be employed within the scope of the present invention.

It is to be understood that while certain forms of the present invention have been illustrated and described herein, it is not to be limited to the specific forms or arrangement of parts described and shown.

What is claimed and desired to be secured by Letters Patent is as follows:

1. A convertible facility, which includes:

a) first and second configurations;

b) first and second activity areas associated with said first and second configurations respectively;

c) each said activity area including opposite ends and opposite sides, said first activity area ends forming the sides of said second activity area and portions of the sides of said first activity area forming the ends of said second activity area;

d) a first configuration seating bowl associated with said first configuration and including opposite end seating sections and opposite side seating sections;

e) a second configuration seating bowl associated with said second configuration and including opposite end seating sections and opposite side seating sections, said first configuration end seating sections forming said second configuration side seating sections and portions of said first configuration side seating sections forming said second configuration end seating sections;

f) at least one of said first configuration end seating sections including a movable component longitudinally movable with respect to said first activity area between first and second positions associated with said first and second configurations respectively;

g) said first configuration activity area including a removable portion with said second activity area located thereunder;

h) at least one of said seating sections having a lower deck; and i) a removable, temporary seating section installed between said second configuration activity area and said lower deck with said facility in its second configuration.

2. The convertible facility according to claim 1, which includes:

a) each said first configuration side seating section having a lower deck; and b) each said lower deck having a retractable seating band retractable from an extended position with said facility in its first configuration to a retracted position with said facility in its second configuration.

3. The convertible facility according to claim 1 wherein each said seating section includes:

a) a lower deck located adjacent to the first activity area with the facility in its first configuration;

b) a lower club deck located above said lower deck;

c) a suite level including a plurality of suites located above said lower club deck;

d) an upper club deck located above said suite level; and e) an upper deck located above said upper club level with said facility in its first configuration.

4. The convertible facility according to claim 3, which includes:

a) an adjustable-height ceiling portion being located approximately between said upper club deck and said upper deck with said facility in its second configuration.

5. The convertible facility according to claim 3, which includes a circulation system including:

a) a main concourse located generally between said lower deck and said lower club deck; and b) an upper concourse located generally between said upper club deck and said upper deck; and c) each said concourse generally encircling said seating bowl.

6. The convertible facility according to claim 5, which includes:

a) a pair of main concourse bridges each extending between the moveable seating section and a respective second configuration end seating section with said facility in its second configuration; and b) a pair of upper club bridges each extending between the moveable seating section and a respective second configuration end seating section with said facility in its second configuration; and c) said main concourse and said upper concourse bridges forming parts of said main and upper concourses respectively with said facility in its second configuration.

7. The convertible facility according to claim 1, which includes:

a) a structural system including said roof.

8. The convertible facility according to claim 1, which includes:

a) support system including service, locker, mechanical offices, concession and toilet accommodations located generally outside of and below said seating bowl.

9. A convertible sports facility, which includes:

a) a football stadium configuration;

b) a basketball/hockey arena configuration;

c) a seating system including:

1) opposite stadium configuration end seating sections;

2) opposite stadium configuration side seating sections;

3) a plurality of stadium configuration corner seating sections each connecting respective stadium configuration side and end seating sections;

4) each said stadium configuration seating section including a lower deck located in proximity to said stadium activity area, a lower club deck positioned above and outwardly from said lower decks, a suite level including a plurality of suites located above and outwardly from said lower club deck, an upper club deck located above and outwardly from said suite level, and an upper deck located above said upper club deck;

5) each said stadium configuration side seating section having a retractable seating band retractable from an extended position adjacent said stadium activity area and a retracted position retracted generally beneath said lower club deck in said arena configuration;

6) a portion of one of said stadium configuration end seating sections comprising a moveable seating section, said moveable seating section being longitudinally moveable with respect to said stadium activity area between a first position comprising part of a stadium end seating section and a second position comprising a respective arena side seating section; and 7) a plurality of removable, temporary seating sections in said arena configuration each located between a respective seating section lower deck and said arena activity area;

d) a circulation system including:

1) a main concourse located generally outwardly from said lower club deck and generally encircling said seating bowl;

2) an intermediate concourse located generally outwardly from said upper club deck and generally encircling said seating bowl;

3) a pair of main concourse level bridges each extending between said movable seating section and a respective arena configuration end seating section in said arena configuration;

4) a pair of intermediate concourse bridges each extending between said moveable seating section and a respective arena configuration end seating section in said arena configuration; and 5) said main concourse level bridges and said intermediate concourse bridges respectively comprising portions of said main and intermediate concourses;

e) a structural system including a roof with a fixed-height ceiling portion and an adjustable-height ceiling portion, said adjustable-height ceiling portion being vertically moveable between a lower, arena position located generally between said upper club deck and said upper deck and a raised, stadium position located generally above said upper deck;

f) a support system including services, lockers, mechanical facilities, offices, concessions and toilets located generally below and outside of said seating bowl;

g) said stadium playing field having an upper stadium playing field level and including a removable playing field portion; and h) said arena playing field being formed by removing said stadium playing field removable portion and said arena playing field having a lower level than said stadium playing field.

10. A convertible facility, which includes:

a) first and second configurations;

b) first and second activity areas associated with said first and second configurations respectively;

c) each said activity area including opposite ends and opposite sides, said first activity area ends forming the sides of said second activity area and portions of the sides of said first activity area forming the ends of said second activity area;

d) a first configuration seating bowl associated with said first configuration and including opposite end seating sections and opposite side seating sections;

e) a second configuration seating bowl associated with said second configuration and including opposite end seating sections and opposite side seating sections, said first configuration end seating sections forming said second configuration side seating sections and portions of said first configuration side seating sections forming said second configuration end seating sections;

f) at least one of said first configuration end seating sections including a movable component longitudinally movable with respect to said first activity area between first and second positions associated with said first and second configurations respectively;

g) at least one of said seating sections having a lower deck;

h) a removable, temporary seating section installed between said second configuration activity area and said lower deck with said facility in its second configuration;

i) each said first configuration side seating section having a lower deck; and j) each said lower deck having a retractable seating band retractable from an extended position with said facility in its first configuration to a retracted position with said facility in its second configuration.

11. The convertible facility according to claim 10, which includes:

a) said first configuration activity area including a removable portion with said second activity area located thereunder.

12. A method of converting a facility from a stadium configuration with a stadium activity area including a playing field with a first level, opposite end seating sections, opposite side seating sections with retractable seating bands and a roof with a ceiling comprising a fixed-height portion and an adjustable-height portion, which includes the steps of:

a) removing a portion of the stadium playing field and forming an arena playing field at a level below the stadium playing field;

b) retracting the retractable seating bands from their extended positions to retracted positions generally below a lower club deck of respective stadium side seating sections c) longitudinally moving a moveable component of a respective end seating section with respect to said stadium playing field from a stadium position forming a component of a respective stadium seating bowl end section to an arena position forming an arena seating bowl side section;

d) providing an arena activity area at a lower level below a level of said stadium playing field;

e) installing removable seating sections at an inner perimeter of the arena seating bowl adjacent to the arena playing field;

f) bridging a main concourse between the moveable component of the end seating section and the stadium configuration side seating sections; and g) lowering said adjustable-height ceiling portion to a lower position thereof.

13. The facility conversion method according to claim 12, which includes the additional steps of:

a) providing an intermediate concourse generally encircling the stadium and arena bowls at an upper club level; and b) bridging an intermediate level concourse between the moveable component of the end seating section and the stadium configuration side seating sections.

14. The facility conversion method according to claim 12, which includes the additional steps of:

a) suspending a score board from the vertically adjustable ceiling portion; and b) lowering the score board from a raised position thereof in a stadium configuration to a lower position thereof an arena configuration.

15. The facility conversion method according to claim 12, which includes the additional steps of:

a) removing stadium goals from ends of the stadium playing field; and b) installing arena goals at ends of the arena activity area.

16. A convertible facility, which includes:

a) first and second configurations;

b) first and second activity areas associated with said first and second configurations respectively;

c) each said activity area including opposite ends and opposite sides, said first activity area ends forming the sides of said second activity area and portions of the sides of said first activity area forming the ends of said second activity area;

d) a first configuration seating bowl associated with said first configuration and including opposite end seating sections and opposite side seating sections;

e) a second configuration seating bowl associated with said second configuration and including opposite end seating sections and opposite side seating sections, said first configuration end seating sections forming said second configuration side seating sections and portions of said first configuration side seating sections forming said second configuration end seating sections;

f) at least one of said first configuration end seating sections including a movable component longitudinally movable with respect to said first activity area between first and second positions associated with said first and second configurations respectively;

g) a lower deck located adjacent to the first activity area with the facility in its first configuration;

h) a lower club deck located above said lower deck;

i) a suite level including a plurality of suites located above said lower club deck;

j) an upper club deck located above said suite level;

k) an upper deck located above said upper club level with said facility in its first configuration;

l) an adjustable-height ceiling portion being located approximately between said upper club deck and said upper deck with said facility in its second configuration;

m) a main concourse located generally between said lower deck and said lower club deck;

n) an upper concourse located generally between said upper club deck and said upper deck; and o) each said concourse generally encircling said seating bowl.

* * * * *